United States Patent [19]

Tsay

[11] Patent Number: 5,002,506

[45] Date of Patent: Mar. 26, 1991

[54] ELECTRICAL PLUG WITH REPLACEABLE FUSE

[76] Inventor: Peir L. Tsay, No. 32, Lane 111, Chang Hsin Rd., Sec. 2, Ho Mei Jenn, Changhua Hsien, Taiwan

[21] Appl. No.: 501,227

[22] Filed: Mar. 29, 1990

[51] Int. Cl.[5] ..... H01R 13/68

[52] U.S. Cl. ..... 439/622; 337/198

[58] Field of Search ..... 439/622, 621; 337/197, 337/198

[56] References Cited

U.S. PATENT DOCUMENTS

| | | | |
|---|---|---|---|
| 2,462,934 | 3/1949 | Athey | 439/621 |
| 4,274,698 | 6/1981 | Ahroni | 439/622 |
| 4,309,068 | 1/1982 | Ahroni | 439/622 |
| 4,309,069 | 1/1982 | Ahroni | 439/622 |
| 4,385,282 | 5/1983 | Ahrani | 337/198 |
| 4,480,891 | 11/1984 | Wu | 439/622 |
| 4,684,914 | 8/1987 | Wu | 439/622 |
| 4,834,664 | 5/1990 | Lin | 439/622 |
| 4,902,250 | 2/1990 | Wu | 439/622 |
| 4,904,976 | 2/1990 | Liaq | 439/622 |

*Primary Examiner*—Gary F. Paumen

*Attorney, Agent, or Firm*—Browdy and Neimark

[57] ABSTRACT

An electrical plug having an additional fuse connecting between the metal prongs in an outlet connected to a power source and the power cord connected to electrical equipment with the fuse having fuse strips along one face of an insulator block and up opposite faces of the insulator block on opposite ends of each of the fuse strips. The insulator block has a threaded hole therethrough aligned with a threaded hole in the bottom of a space or cavity in the plug with a screw threaded through both holes to maintain the insulator block in the space and in tight electrical contact with the tips of wires from the power cord and the edges of the prongs.

7 Claims, 1 Drawing Sheet

ELECTRICAL PLUG WITH REPLACEABLE FUSE

BACKGROUND OF THE INVENTION

The present invention refers to a plug featured with a safety design so that when equipment connected by a power cord to the plug overloads, the fuse in the plug will automatically break the circuit in only that power cord.

In general, the conventional power outlet can be of single, or multiple style, in which a fuse is often equipped to protect the overall circuit. In such a case, it will be found that the outlet will shut down completely since the fuse will disconnect the outlet from the power source. However, it is to be understood that most outlets are not equipped for only a single plug.

SUMMARY OF THE INVENTION

Therefore it is an object of the present invention to develop a suitable device to deal with the case of multiple outlets connected to a single power source.

It is still another object of the present invention that since a fuse is used in addition to that used in current practice, a better safety result can be expected without sacrificing ease and convenience of use of multiple outlets.

In accordance with above objects and advantages, in the present invention each plug has its own fuse with no interference or interruption of operation to the other outlet connections.

Also, a fuse can be replaced very easily and with less need of expertise.

In addition, it is probable that no short will occur of circuit be damaged, since there is no direct connection without a fuse between equipment and power source.

Also, due to the simplicity of the design, maintenance of the plug and replacement of the fuse is easy while the unit remains at a low cost.

Thus, when appliances or other electrical equipment are being used together from the same multiple outlet, if one of the pieces of equipment is subjected to an extremely large current, it may burn out due to overloading but with the additional safety of the present invention, the damage can be limited and the other equipment may continue in operation.

BRIEF DESCRIPTION OF THE DRAWINGS

For a better understanding of the invention, reference is made to the accompanying drawings and descriptive matter in which a preferred embodiment of the invention is illustrated.

DETAILED DESCRIPTION OF A PREFERRED EMBODIMENT

Figure 1:
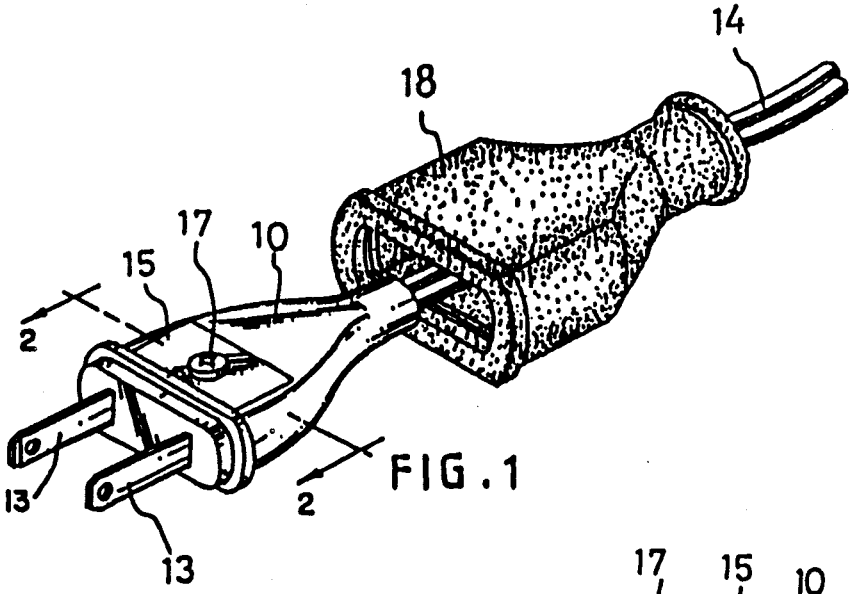
FIG. 1 is a perspective view of the present invention with the plug extended from its casing.
Figure 2:
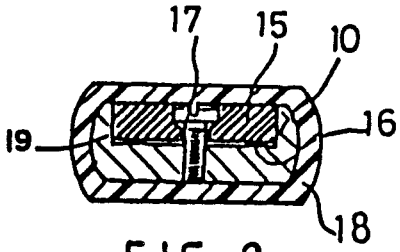
FIG. 2 is a partial cross section view seen from the front along line 2—2 of FIG. 1.
Figure 3:
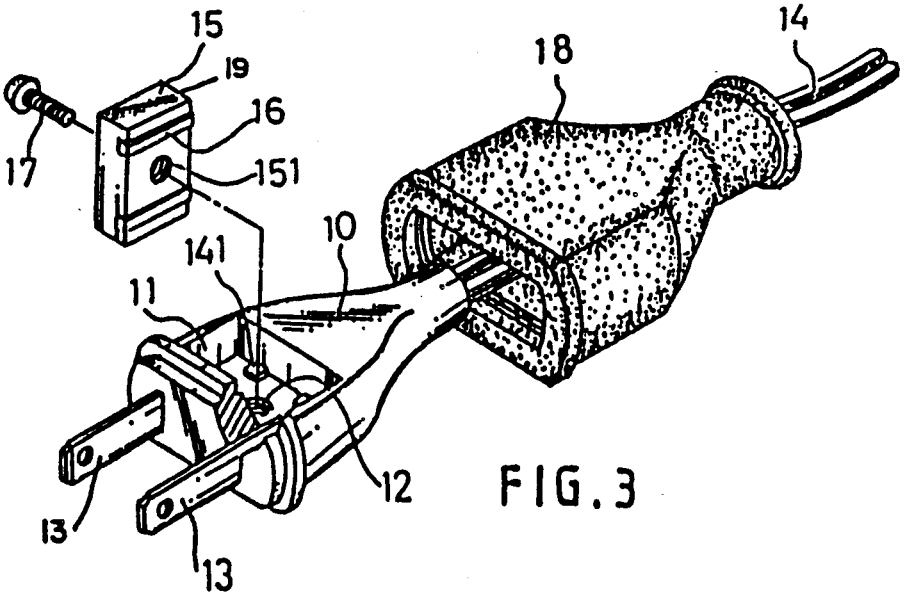
FIG. 3 is an exploded view of the present invention of FIG. 1.

Referring to FIGS. 1, 2 and 3, plug 10 is connected through power cord 14 to electrical equipment (not shown) and through metal prongs 13 to an outlet (not shown) which is connected to a power source.

Extending into a space of cavity 11 in plug 10 are tip portions 141 which are the tips of the wires in power cord 14 and the ends of metal prongs 13 opposite from the ends that plug into an outlet, both being of conductive material.

An insulator 15 has fuse strips 16 which run in strips along a bottom face of the insulator 15 and partly up at least one face of insulator 15 on the side facing the ends of metal prongs 13 facing inward in the plug.

With insulator 15 fitted with fuse strips 16 inward, the insulator 15 fits into cavity 11 and is held tightly down for good contact of fuse strips 16 against tip portions 141 and edges of metal prongs 13 by a screw 17 which passes through and screws into threaded holes 151 in insulator 15 and 12 in plug 10 at the base of cavity 11, respectively.

Then for further safety the outer casing 18 is slipped over plug 10 with insulator 15 thus more securely held in the cavity 11 and against conductive tip portions 141 and metal prongs 13, completing the circuit between electrical equipment and power source.

A thin mica slab 19 may be used between the insulator 15 and fuse strips 16 for increased safety in case of extreme overload conditions. Insulator 15 may be made of a bakelite, clay materials or similar material and the insulator may be shaped as a rectangular thin bar or plate.

Thus advantages of the present invention are such that

- when a multiple outlet of several plugs has an overload at one or more plugs, with the present invention, the other plugs and equipment connected thereto can continue operation;
- with the present invention, when the plug is used the equipment used is thereby protected by the additional fuse;
- maintenance and fuse replacement is simple with the need to only unscrew one screw and remove and replace a thin bar shaped fuse;
- with the simplicity of structure, the present invention is easily and economically manufactured.

Fuses are standardized and made to meet the requirements of different loads in the electrical circuits.

What is claimed is:

1. An electrical plug for connecting electrical equipment to a power source through an outlet, comprising:
   - a plug having a power cord extending from one end to be connected to the electrical equipment and metal prongs extending from the opposite end to be connected through the outlet to the power source;
   - a cavity in said plug;
   - exposed tip portions of wires of said power cord extending into said cavity from one side of said cavity;
   - end portions of said metal prongs extending into said cavity from the opposite side of said cavity;
   - a threaded hole in said plug extending from said cavity;
   - an insulator shaped to fit into said cavity;
   - a pair of fuse strips on a face of said insulator extending between said exposed tip portions and respective said end portions closing the circuit therebetween;
   - a hole in said insulator aligned with said threaded hole in said plug;
   - a screw fitted through said hole in said insulator and into said threaded hole in said plug;
   - and an outer casing fitted over said plug and said insulator.

2. The electrical plug of claim 1 wherein said fuse strips extend across one face of said insulator and partially up an adjacent face of said insulator wherein a part of said strip extending partially up an adjacent face contacts said end portions of said metal prongs.

3. The electrical plug of claim 2 wherein said fuse strips extend longitudinally between said exposed tip portions and said metal prongs.

4. The electrical plug of claim 1 wherein said insulator is made of bakelite.

5. The electrical plug of claim 1 wherein said insulator is made of clay materials.

6. The electrical plug of claim 1 wherein said insulator is made in a thin rectangular bar shape.

7. The electrical plug of claim 1 wherein a mica plate is positioned between said insulator and said fuse strips.

* * * * *